US008950591B1

(12) United States Patent
McDowell

(10) Patent No.: US 8,950,591 B1
(45) Date of Patent: Feb. 10, 2015

(54) PONYTAIL HOLDER

(76) Inventor: Anita McDowell, Fort Worth, TX (US)

( * ) Notice: Subject to any disclaimer, the term of this patent is extended or adjusted under 35 U.S.C. 154(b) by 204 days.

(21) Appl. No.: 13/418,586

(22) Filed: Mar. 13, 2012

(51) Int. Cl.
*A47F 7/00* (2006.01)
*A45D 19/04* (2006.01)

(52) U.S. Cl.
USPC ..... 211/13.1; 248/127

(58) Field of Classification Search
CPC . A45D 44/02; A45D 44/04; A45D 2008/002; A45D 8/185; A45D 44/00; A45D 44/14; A47F 7/065; A47F 5/04; A47F 5/0876; A47F 5/0884; A47G 29/08
USPC ..... 211/85.2, 85.3, 33, 37, 13.1, 32; 248/127, 105, 125.8, 139, 125.9, 248/188.5, 161; 132/105; 223/120
See application file for complete search history.

(56) References Cited

U.S. PATENT DOCUMENTS 1,602,957 A * 10/1926 Weigel ..... 132/314
2,006,033 A 4/1933 Sharpe
2,639,820 A * 5/1953 Lee ..... 211/163
3,128,882 A 7/1963 Kardulas
3,108,723 A * 10/1963 Hickey ..... 223/66
3,221,891 A * 12/1965 Snow ..... 211/13.1
3,658,283 A 11/1969 Martin
3,515,318 A 6/1970 Preble
3,602,372 A 8/1971 Verrecchio
3,820,694 A 4/1973 Pabis
3,779,433 A 12/1973 Imai
3,809,383 A * 5/1974 Ptacek ..... 269/91
4,380,296 A * 4/1983 Murray et al. ..... 209/704
4,936,466 A * 6/1990 Nava ..... 211/85.2
5,598,585 A * 2/1997 Stroup ..... 2/171
5,899,211 A * 5/1999 Brown ..... 132/201
6,095,346 A * 8/2000 Idelberger ..... 211/85.2
D430,430 S 9/2000 Malapane
6,769,554 B1 * 8/2004 Udofiah ..... 211/70.6
6,913,230 B2 * 7/2005 Wells ..... 248/127
7,028,853 B1 * 4/2006 Simms ..... 211/85.3
7,775,377 B2 * 8/2010 Abney ..... 211/13.1
7,828,254 B2 * 11/2010 Stephens-De Alanis ..... 248/158
8,439,210 B1 * 5/2013 Griffith ..... 211/119.004
2006/0260634 A1 * 11/2006 Henricksen et al. ..... 132/275
2006/0289367 A1 * 12/2006 Cossey ..... 211/13.1

* cited by examiner

*Primary Examiner* — Patrick Hawn
(74) *Attorney, Agent, or Firm* — Eric Karich

(57) ABSTRACT

A ponytail holder apparatus has a base, an elongate support element extending upwardly from the base, and a holder element operably mounted on the elongate support element so that the holder element is positioned above the base. The holder element is comprised of a front surface and a rear hook element extending downwardly from the holder element. The drawstring ponytail may be hooked by the rear hook element and draped over the front surface to hang from the holder element over the base.

2 Claims, 2 Drawing Sheets

PONYTAIL HOLDER

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to an accessory for holding artificial hair extensions, and more particularly to a ponytail holder for displaying and storing drawstring ponytails.

2. Description of Related Art

The following art defines the present state of this field:

H. Preble, U.S. Pat. No. 3,515,318, teaches a collapsible wig stand that is adapted to collapse and form its own carrying case. The stand includes a base, a support post, and a dome-shaped top portion that is adapted to receive and support the wig.

Verrecchio, U.S. Pat. No. 3,602,372, teaches a support rack for displaying several wigs. The rack includes a plurality of adjustable head block support stands movably mounted in a C-shaped channel member. A clamp assembly at each end of said channel member is used for securing said channel member between any two walls.

Imai, U.S. Pat. No. 3,779,433, teaches a wig stand having a top portion adapted to support a wig and mounted to a base portion by a telescoping shaft. The base contains a receptacle which surrounds the telescoping shaft and is covered by a cover having an aperture sized to receive said shaft. The top portion includes a plurality of smaller apertures through which pins may be pressed to fasten said wig to said stand as well as a plurality of larger apertures which have raised edges protruding upwardly from said top portion for engaging the underside of said wig and providing ventilation thereto. Also see Martin, U.S. Pat. No. 3,658,283.

Other patents of interest include Pabis, U.S. Pat. No. 3,820,694, C. E. Sharpe, U.S. Pat. No. 2,006,033, R. Kardulas, U.S. Pat. No. 3,128,882, T. R. Snow, U.S. Pat. No. 3,221,891, Wells, U.S. Pat. No. 6,913,230, and Malapane, U.S. D430,430.

The prior art teaches a variety of mechanisms for displaying and maintaining wigs. However, the prior art does not teach a device for securing, storing, and displaying individual drawstring ponytails having the advantages described below. The present invention fulfills these needs and provides further related advantages as described in the following summary.

SUMMARY OF THE INVENTION

The present invention teaches certain benefits in construction and use which give rise to the objectives described below.

The present invention provides a ponytail holder for holding a drawstring ponytail. The ponytail holder includes a base, an elongate support element extending upwardly from the base, and a holder element operably mounted on the elongate support element so that the holder element is positioned above the base. The holder element is comprised of a front surface and a rear hook element extending downwardly from the holder element. The drawstring ponytail may be hooked by the rear hook element and draped over the front surface to hang from the holder element over the base.

A primary objective of the present invention is to provide a ponytail holder having advantages not taught by the prior art.

Another objective is to provide a ponytail holder that can securely hold one or more drawstring ponytails, according to what is desired by the user.

Another objective is to provide a method of storing and displaying drawstring ponytails without tangling or creasing the strands of artificial hair.

A further objective is to provide a ponytail holder that may be adjusted to allow for different lengths of hair.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a ponytail holder 10 for holding at least one drawstring ponytail 20.

Figure 1:
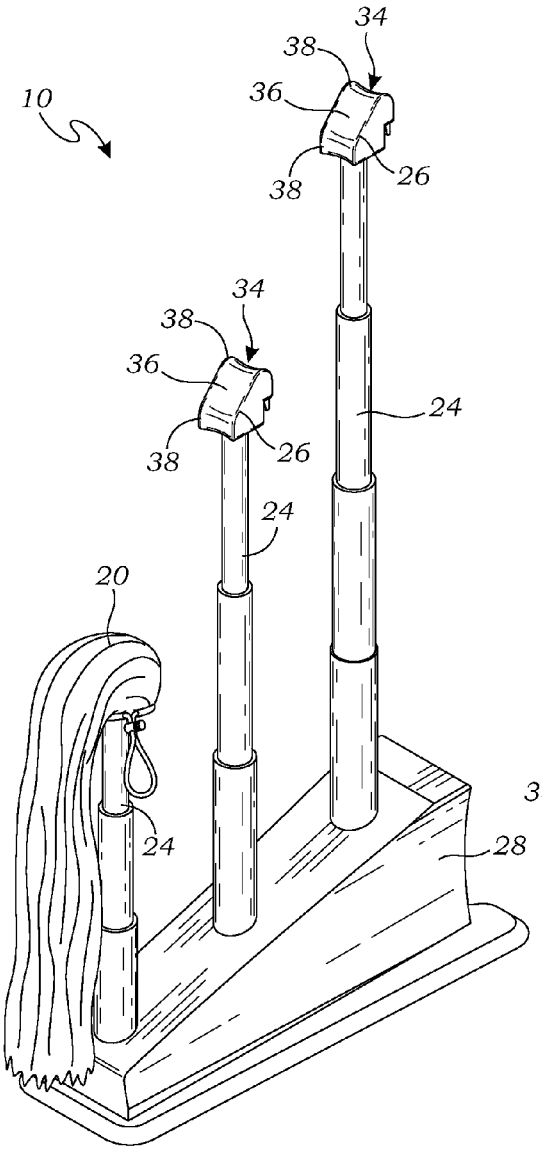
FIG. 1 is a perspective view of a ponytail holder according to one embodiment of the present invention.
Figure 2:
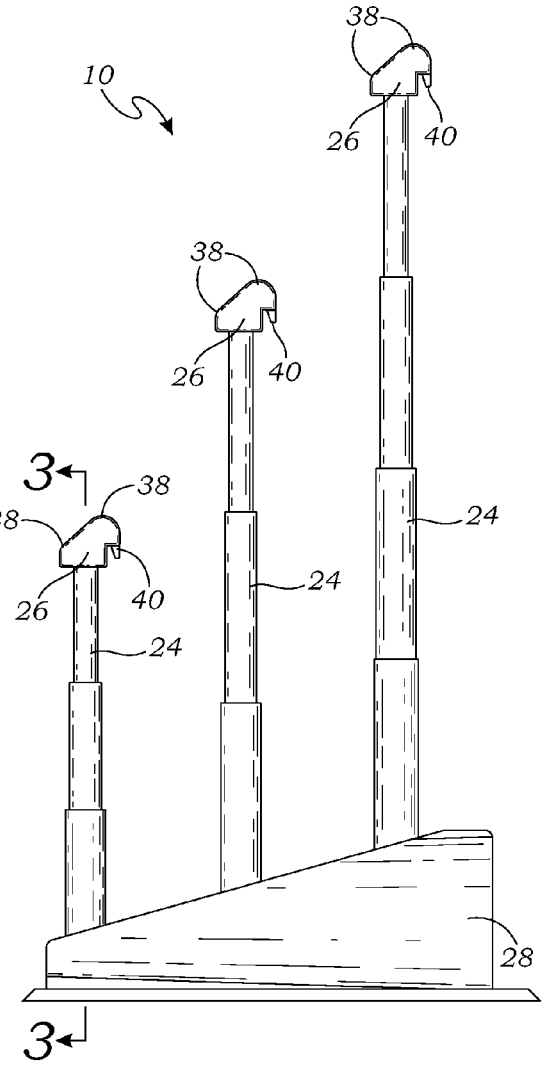
FIG. 2 is a side elevational view of the ponytail holder.
Figure 3:
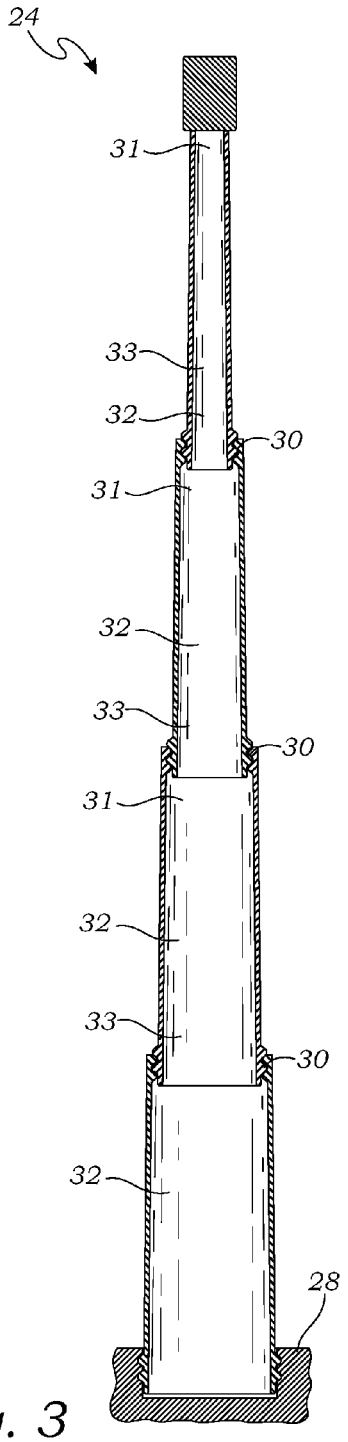
FIG. 3 is a sectional view thereof taken along line 3-3 in FIG. 2.
Figure 4:
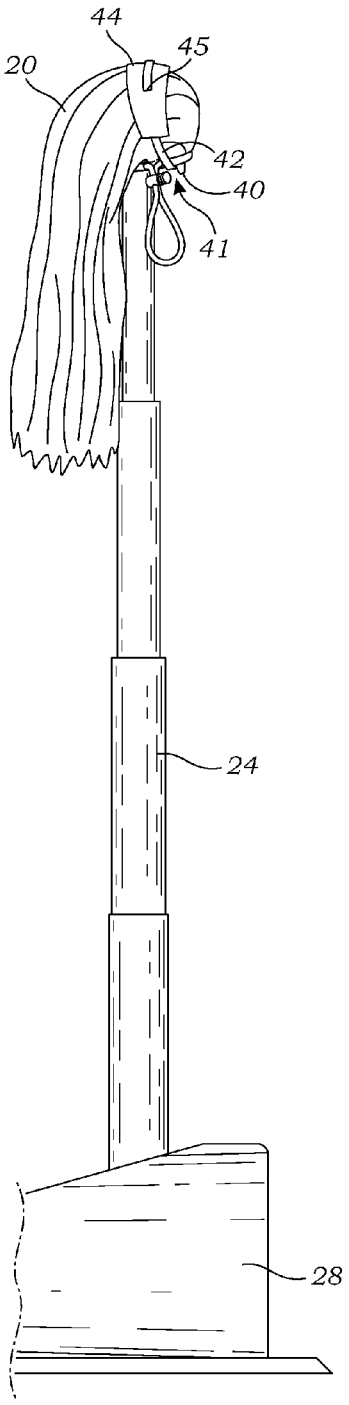
FIG. 4 is a side elevational view of the ponytail holder, illustrating a drawstring ponytail being mounted on the holder element.

FIG. 1 is a perspective view of one embodiment of the ponytail holder 10. FIG. 2 is a side elevational view thereof, illustrating a base 28, elongate support elements 24 and holder elements 26 of the ponytail holder 10. FIG. 3 is a sectional view thereof taken along line 3-3 in FIG. 2. FIG. 4 is a side elevational view of the ponytail holder 10, illustrating a drawstring ponytail 20 being mounted on the holder element 26.

As shown in FIGS. 1-4, the base 28 is adapted for supporting the ponytail holder 10 on a surface, such as a countertop (not shown), where a person stores his or her hair accessories. The shape and construction of the base 28 may vary depending upon the design of the ponytail holder 10, so long as it is stable enough to stand upright in a suitable manner. The base 28 may further include additional elements, as desired, but these alternatives are not discussed herein.

The base 28 supports at least one elongate support element 24. The elongate support element 24 functions to hold and support the drawstring ponytail 20, so that the hair is not damaged or bent. In one embodiment, the base may support a plurality of the elongate support elements 24; however, the number and arrangement of such elements may vary depending upon the needs of the user.

The elongate support element 24 extends upwardly from the base 28 and may be telescopically adjustable to adjust to different lengths of the drawstring ponytail 20. Although the elongate support element 24 may be formed from a single element having a fixed length, it is preferred for the elongate support element 24 to include telescopically adjustable elements 32 to allow the elongate support 24 to be adjustable in height.

Each of these telescopically adjustable elements 32 may include a distal end 31 and a proximal end 33. Each of the distal and proximal ends 31 and 33 may include annular ridges 30 for locking the adjustable elements 32 in an extended position. The annular ridge 30 of the distal end 31, for example, may interlock with the corresponding annular ridge 30 of the proximal end 33 of the adjacent telescoping section 32 in order to extend the telescopically adjustable elements 32. In such an embodiment, the telescoping sections 32 of the elongate support 24 element may have an appropriate friction to remain extended and may also be collapsible to a collapsed position.

The holder element 26 of the ponytail holder 10 may be operably mounted on the elongate support element 24 so that the holder element 26 is positioned above the base 28. The holder element 26 is shaped for holding the drawstring ponytail 20 in a manner that does not bend, break, damage or otherwise harm the drawstring ponytail 20.

In one embodiment, the holder element 26 may include a front surface 34 and a rear hook element 40 extending downwardly from the holder element 26, generally parallel to the holder element 26. In the embodiment of FIGS. 1-4, the front surface 34 may be concave; however, alternative forms of the front surface 34 are considered within the scope of the present invention.

The front surface 34 may include curved edges 38 that form a channel 36 therebetween, for holding the drawstring ponytail 20 in a preferred configuration.

As illustrated in FIG. 4, the drawstring ponytail 20 may be slipped over the top of the holder element 26 and secured to the ponytail holder 10 by a drawstring of the drawstring ponytail 20. The drawstring ponytail 20 is draped over the front surface 34 to hang from the holder element 26 over the base 28. In this manner, the majority of the drawstring ponytail 20 may hang freely, therefore preventing the tresses from being tangled or soiled. The drawstring ponytail 20 may be easily removed for use by loosening the drawstring, so as to minimize the amount of time and effort a user must exert detangling and preparing the drawstring ponytail 20 for use. Furthermore, the pony tail holder 10 of FIGS. 1-4 may display a variety of drawstring ponytails 20, thus providing a consumer with a proper means of storing his or her drawstring ponytail, without causing premature damage to the artificial hair.

Furthermore, the ponytail holder 10 may also include an elastic band 42 used to provide additional security for heavier weighing drawstring ponytails 20. After the drawstring ponytail 20 has been hooked onto the holder element 26, the elastic band 42 may be slipped over the drawstring ponytail 20 and under the hook element 40, into a recess 41 formed between the rear hook element 40 and the holder element 26. The elastic band 42, therefore, serves to further secure the drawstring ponytail 20 to the holder element 26.

In the current embodiment of FIG. 4, the elastic band 42 is a cloth-covered hair tie which may be inserted through apertures 45 on an optional fabric protector sheet 44. The user may minimize creasing and/or indenting the artificial hair by using the elastic band 42 in conjunction with the fabric protector sheet 44.

Using the ponytail holder 10, it is therefore easily possible to keep drawstring ponytails 20 organized, controlled, and untangled. As a result, the pony tail holder 10 may extend the lifecycle of each drawstring ponytail 20; thus making the process of attaching drawstring ponytails both more convenient and efficient, while minimizing the cost of hair that must be thrown away due to damage.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A ponytail holder comprising:

a drawstring ponytail;

a base;

an elongate support element extending upwardly from the base, wherein the elongate support element includes telescopically adjustable elements that telescopically engage each other to adjust in height to accommodate drawstring ponytails having different lengths of hair; and a holder element operably mounted on the elongate support element so that the holder element is positioned above the base, the holder element comprising:

a front surface that is concave, having upwardly extending edges that form a channel therebetween; and a rear hook element extending downwardly from the holder element opposite the channel of the front surface and substantially parallel to the elongate support element, wherein the drawstring ponytail is hooked by the rear hook element and draped over the front surface, to hang from the holder element over the base; and an elastic band with which the drawstring ponytail is secured to the holder element, the elastic band being positioned over the front surface and around the holder element into a recess formed between the rear hook element and the holder element.

2. The elastic band of claim 1, wherein the elastic band further includes a fabric protector sheet between the elastic band and the holder element to minimize creasing or indenting of the artificial hair.

* * * * *